US008684625B2

(12) United States Patent
García García et al.

(10) Patent No.: US 8,684,625 B2
(45) Date of Patent: Apr. 1, 2014

(54) DEVICE FOR LIMITING THE SPEED OF MOVING TRAFFIC

(75) Inventors: Alfredo García García, Valencia (ES); Mario Alfonso Romero Rojas, Valencia (ES)

(73) Assignee: Universidad Politecnica de Valencia, Valencia (ES)

( * ) Notice: Subject to any disclaimer, the term of this patent is extended or adjusted under 35 U.S.C. 154(b) by 0 days.

(21) Appl. No.: 13/360,840

(22) Filed: Jan. 30, 2012

(65) Prior Publication Data

US 2012/0189385 A1 Jul. 26, 2012

Related U.S. Application Data

(63) Continuation of application No. PCT/ES2010/070498, filed on Jul. 19, 2010.

(30) Foreign Application Priority Data

Jul. 31, 2009 (ES) ..... 200901749

(51) Int. Cl.
*E01F 11/00* (2006.01)
*E01F 9/00* (2006.01)

(52) U.S. Cl.
USPC ..... 404/15; 404/9

(58) Field of Classification Search
USPC ..... 404/6, 9, 12, 15, 16
See application file for complete search history.

(56) References Cited

U.S. PATENT DOCUMENTS 1,696,637 A * 12/1928 Jordan ..... 238/3
1,732,869 A * 10/1929 Wambach ..... 40/615
1,843,746 A 2/1932 Tibbetts
3,334,554 A * 8/1967 Adams ..... 116/63 P
4,135,839 A * 1/1979 Engwall ..... 404/16
4,687,369 A * 8/1987 McDonald ..... 404/12
5,242,242 A * 9/1993 Young ..... 404/12
5,295,759 A * 3/1994 Flanders et al. ..... 404/15
5,419,652 A * 5/1995 Flanders ..... 404/15
6,623,206 B1 * 9/2003 Blair et al. ..... 404/16
6,752,564 B1 * 6/2004 Iskhakbayev ..... 404/6
7,591,606 B2 * 9/2009 Moscovitch ..... 404/15
7,967,526 B2 * 6/2011 Aguilera Galeote ..... 404/15
2002/0046692 A1 * 4/2002 Pharo et al. ..... 116/200
2007/0237579 A1 10/2007 Moscovitch

FOREIGN PATENT DOCUMENTS

CN 201212132 3/2009
DE 200 16 975 3/2001

OTHER PUBLICATIONS

International Search Report issued Oct. 18, 2010 in International (PCT) Application No. PCT/ES2010/070498.

* cited by examiner

*Primary Examiner* — Thomas B Will
*Assistant Examiner* — Abigail A Risic
(74) *Attorney, Agent, or Firm* — Wenderoth, Lind & Ponack, LLP.

(57) ABSTRACT

The invention relates to a device for limiting the speed of moving traffic. The device comprises at least one protruding element positioned on the surface of a road that is open to traffic. The protruding element wherein the shape and dimensions thereof are such that it affects only vehicles of certain sizes, the speed of which is going to be controlled. Likewise, vehicles travelling at an acceptable speed and along an appropriate path are also not affected by the device of the invention.

12 Claims, 3 Drawing Sheets

"REPLACEMENT SHEET"

DEVICE FOR LIMITING THE SPEED OF MOVING TRAFFIC

This application is a Continuation of international application PCT/ES2010/070498, filed Jul. 19, 2010, which is hereby incorporated by reference in its entirety.

OBJECT OF THE INVENTION

The invention refers to a device for limiting the speed of moving traffic. The device comprises at least one protruding element positioned on the surface of a road that is open to traffic.

The protruding element wherein the shape and dimensions thereof are such that it only affects vehicles of certain sizes, the speed of which is going to be controlled. Likewise, vehicles travelling at an acceptable speed and along an appropriate path are also not affected by the device of the invention.

BACKGROUND OF THE INVENTION

Among the systems for limiting the speed of moving traffic, we can find different elements, devices and techniques. There are some actions that imply a change of the ground path of the vehicles and others that imply a modification of the cross section. The most common methods involve a change in the slope of the road by adding prefabricated elements, or "in situ" actions that require vehicles to pass them reducing their speed, but they are uncomfortable to the occupants, noisy in the environment, they produce mechanical breakdowns and they even cause accidents sometimes. Another disadvantage is that most of the protruding elements are applied equally to all types of vehicles, causing delays in response times for emergency vehicles such as fire engines, ambulances, etc.

The object of the present invention is the provision of devices for limiting the speed of moving traffic in order to minimize the inconvenience to all light vehicles that run at an appropriate speed, public transport vehicles, heavy goods vehicles and emergency service vehicles, such as fire engines and ambulances.

DESCRIPTION OF THE INVENTION

In places where the road designs in order to maximize flows and speeds, i.e. mobility, still exist, it can be found that most users reject devices for liming speed. In those places, it is wrongly thought that when the speed goes up, the travelling times always decrease, or, on the contrary, that when the speed goes down, there are more traffic jams.

Supposedly, the speed reduction reduces the space available for possible crossings or overtaking of vehicles. However, these concepts are taken from the "continuous traffic flow" theory, while in cities it is clear that due to the intersections and interactions with other elements, such as pedestrians or cyclists, there is an intermittent traffic flow.

The models applied just in urban roads and other studies show how the maximum operating speeds are between 30 km/h and 60 km/h, peaking at about 45 km/h.

Although the impact on the road capacity is not significant, it is on the quality of life in cities, where the implications arising from the reduction of operating speeds are important.

Speed reduction reduces the risk of accidents because at a fast speed, the events happening near the sides of the vehicle, such as pedestrians crossing the street or children playing on sidewalks, go unnoticed. On the other hand, if the speed is high, the severity of accidents is higher too. Pedestrian safety mostly depends on the speeds of the vehicles: a speed of 50 km/h increases the risk of death almost eight times compared to 30 km/h, and 2.6 times compared to 40 km/h.

Speed is also an important factor in fuel consumption of vehicles, in their polluting emissions and in the noise levels. However, in an urban area, the speed reduction is not so directly translated into the reduction of these factors as much as in increasing road safety.

Finally, the reduction of the number of vehicles and speed reduction can solve the problems caused by environmental and social conflicts related to traffic.

The device for limiting the speed of moving traffic comprises at least one protruding element designed to be positioned on the surface of a road that is open to traffic in such a way that it can intervene in the path and, as a consequence, in the speed of the vehicle.

The protruding element wherein it comprises:

- A directrix line which in a plan view has a curve shape and it is positioned in the direction of the vehicle in such a way that the width of the projection of the protruding element on a transverse plane to the lane is greater than the width between wheels of the same axis of the largest vehicle whose speed is going to be controlled;
- A cross-section to the directrix line that is reduced at the ends of the protruding element and bulged outward in the center, and the maximum width of the cross-section being less than or equal to the width between wheels of the same axis of the smallest vehicle whose speed is going to be controlled.

The device object of the invention is an element for limiting the speed of moving traffic that belongs therefore to the category "actions on the track in plan view", as well as "actions on the track in elevation" and, to a lesser extent, "actions on the cross section" because it comprises some discontinuous transverse protruding elements whose geometry in plan view allows the flow of certain vehicles without them being affected either by their size or because they follow a curved path in relation to the directrix line of the protruding element. This curved path is therefore similar to that applied in a chicane, but with the advantage that no action is required on the design of the road.

The maximum width of the cross section of the protruding element will therefore be less than or equal to the vehicle with the narrowest width between axes so that it can pass by without going up the protruding element when following the curved path of the directrix of the protruding element.

The curved shape in plan view avoids the direct flow of vehicles because it guarantees that the width of its projection on the transverse plane to the road is greater than the width of the axes of the largest vehicle whose speed is going to be controlled. Therefore, if a light vehicle intends to follow a straight path will have to go up the protruding element, feeling the inconvenience that it produces. In contrast, if it is a heavy vehicle with a greater separation of the wheels of its own axes, it will be able to do it, but always with caution and, therefore, with some speed reduction.

The cross-section to the directrix is reduced at the ends of the protruding element and bulged outward in the center also has the advantage that it facilitates the vehicle to follow the path along the protruding element since the effect of gravity helps the vehicle in falling to the road and therefore in following the path designed by the bulged protruding element.

The devices can be built "in situ" or be prefabricated and installed not only on those streets functionally classified as "local streets", but also in collector roads and side streets.

Unlike the transverse protruding elements, they can be installed regardless of the composition of the traffic flow because they have no negative impact on heavy vehicles, motorcycles or bicycles.

With these devices for limiting the speed of moving traffic in this invention, several objectives are achieved, including:

- To moderate the speed of vehicles with more than two wheels.
- To reduce the speed of light vehicles (cars).
- To minimize the inconvenience to the occupants of any vehicle when driving at the proper speed.
- To reduce breakdowns and damages in vehicles due to the fact that they do not have to deal with bumps in height.
- To avoid side effects that moderators of traffic have on emergency vehicles and public transport vehicles.
- To allow that the emergency vehicles can continue running at normal speeds, reducing their emergency response times,
- To improve road safety by moderating speeds.

DESCRIPTION OF DRAWINGS

This descriptive memory is completed with some illustrative plans of the preferred embodiment but not limiting.

DETAILED DESCRIPTION OF THE PREFERRED EMBODIMENT

Figure 1:
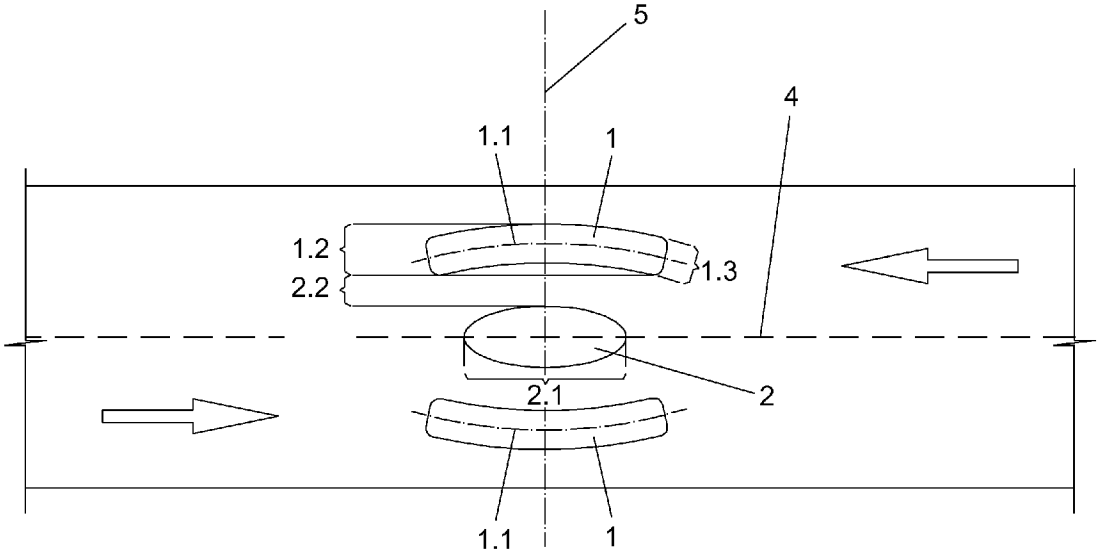
FIG. 1 is a horizontal schematic representation of an embodiment of the device of the invention, which comprises two protruding elements, one on each direction of the road.
Figure 2:
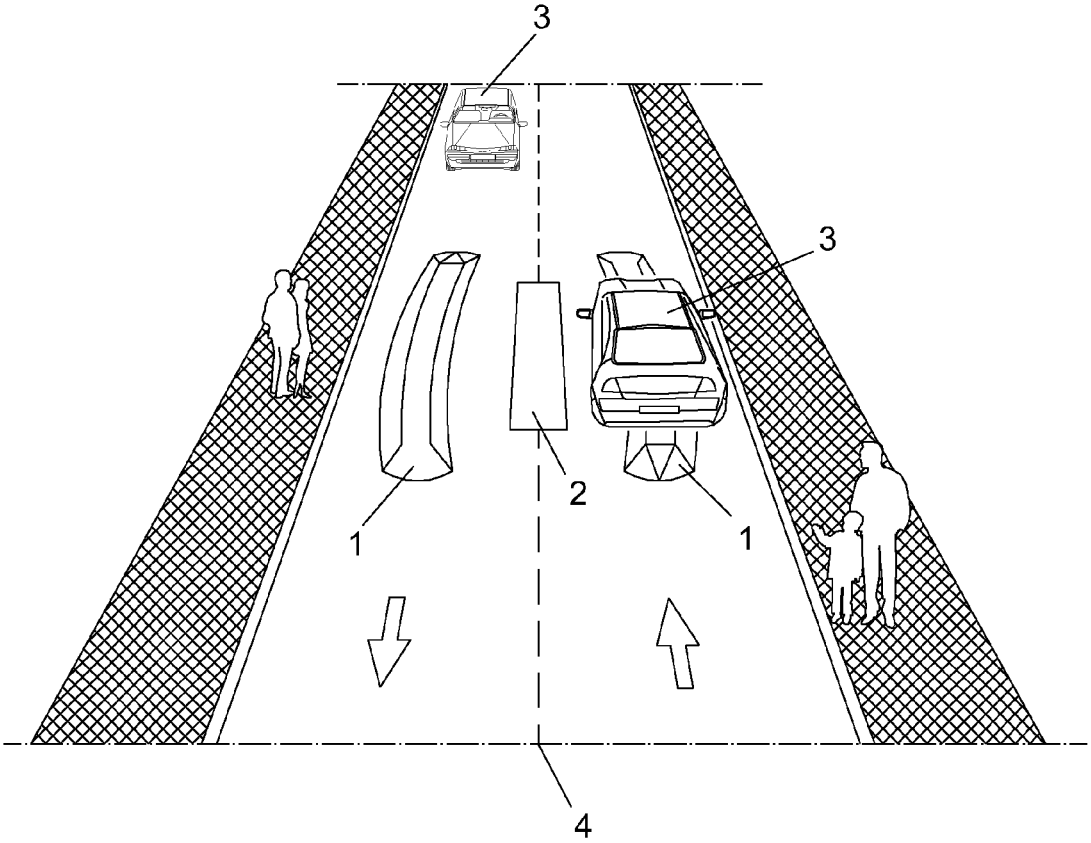
FIG. 2 is a perspective view of an embodiment in which a car is on a protruding element, following its path and curved geometry.
Figure 3A:
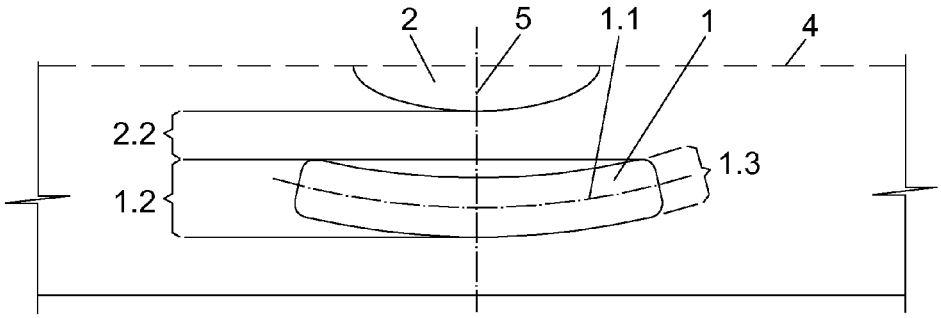
FIGS. 3*a*, 3*b*, 3*c* and 3*d* are horizontal schematic representations of the protruding element and the hump placed on a single lane road where the hump comprises a half ellipse shape or a semicircle shape or a triangular shape or a rectangular shape.
Figure 3B:
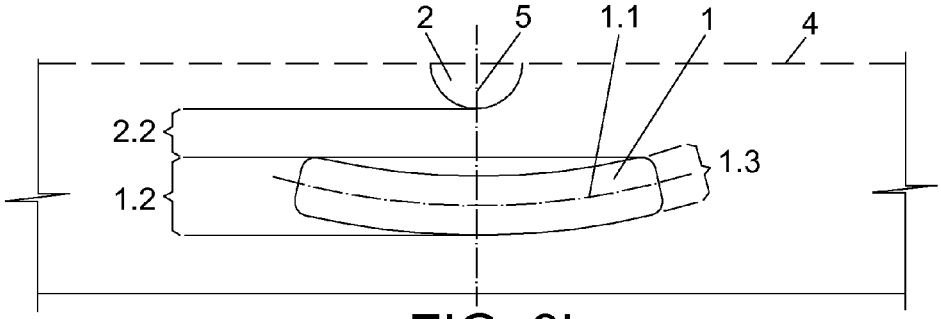
Figure 3C:
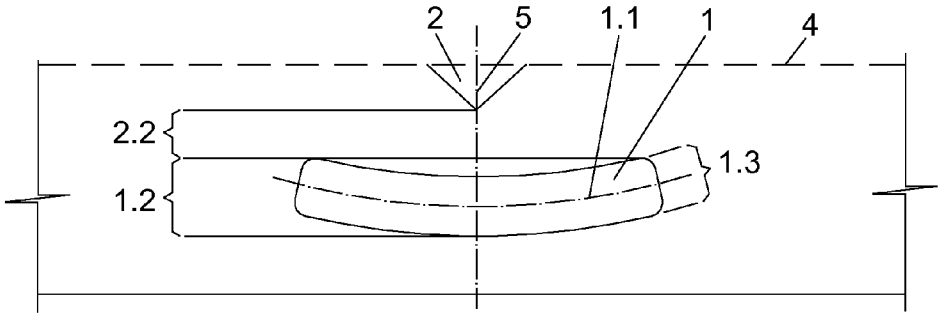
Figure 3D:
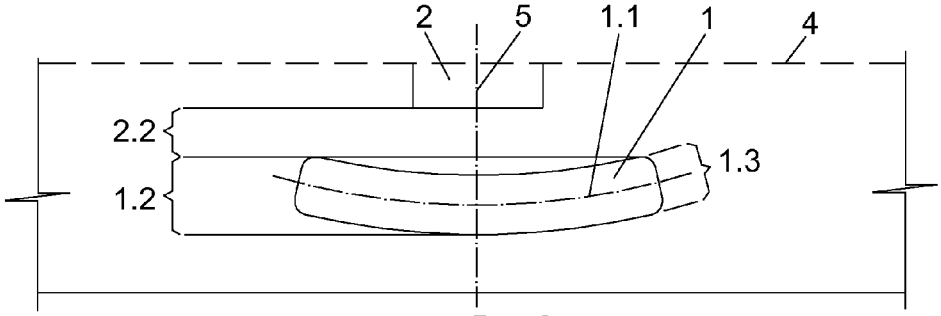

The device for limiting the speed of moving traffic in the embodiment shown in the figures comprises two protruding elements (1) placed on each lane of the road in both directions. The curvature of each protruding element (1) determines a path to the left in each direction, so that the protruding elements (1) are presented symmetrically in relation to the axis of the road, but this does not necessarily have to be like this because, for example, the protruding elements (1) does not necessarily have to have all its length to complete its longitudinal symmetry. The curved path of the protruding elements (1) does not have to be necessarily to the left according to the direction of the road. However, this path to the left is preferred because in a two-way road the tangent of the protruding element (1) in the approach area of the vehicle does not run towards the opposite lane, which improves traffic safety.

Other arrangements are possible. For example: the provision of a single protruding element (1) on one-way roads or the provision of several protruding elements (1) on each lane of a multi-lane road in the same direction. In this case, the protruding elements (1) being placed in parallel instead of symmetrically, although the symmetrical arrangement would also be possible.

The protruding elements (1) consist of a directrix line (1.1) that has a curved shape and is located in the direction of the road.

The width (1.2) of the projection of the protruding element (1) on a transverse plane (5) to the road is greater than the width between the wheels of the largest vehicle axis (3) whose speed is going to be controlled. The maximum width (1.3) of the cross section is also less than or equal to the width between the wheels of the same minor axis of the vehicle whose speed is going to be controlled. In the illustrated embodiment, the cross section of the directrix (1.1) is constant throughout the length of the protruding element (1), but it could also be variable. This with the necessary transitions in height at the entrance and exit.

The protruding element's length must allow the development of its horizontal curvature to comply with the two aforementioned conditions in width. However, the protruding element (1) must not necessarily be symmetric, nor transversely or longitudinally.

The cross section is the usual section for the existing protruding elements (1), in other words, they are of a certain height so as to dissuade drivers from passing by, but not being an obstacle for the smallest ones, with the usual wedged side transitions of its height.

The device of the invention can or cannot include an additional protruding element (or "hump") (2) to avoid that a vehicle run between a protruding element (1) and the curb, or between two protruding elements (1) through the corresponding free space, which is unaffected by them (1). In the case of very narrow roads, the additional protruding element (2) would not be necessary.

The additional protruding element (2) would be placed on at least one side of the lane or lanes, so that the distance (2.2) between the protruding element (1) and the additional protruding element (2) is less than the one between the wheels of the same minor axis of the vehicle whose speed is going to be controlled.

In the event that the additional protruding element (2) is placed on a road with more than one lane, the longitudinal axis (2.1) of the additional protruding element (2) would coincide with the separation lines of traffic lanes or directions, depending on the case. Thus, it also has the function of separator between lanes, apart from the function stated above. Furthermore, if there is a possibility that the vehicles can run on the axis (4) of the road or the line separating the lanes, the maximum width of the additional protruding element (2) will be greater than the separation of wheels of the same axis of the largest vehicles whose speed is going to be controlled.

The additional protruding element (or "hump") (2) in the embodiment shows an elongated elliptical shape, but since it is an accessory that does not depend on the functionality of its shape, it can be of any shape provided that it prevents the traffic flow between protruding elements (1). In the event that it is located on a single lane road, that could be of a half-ellipse shape, of one or more semicircles shape, of a triangular shape, of a rectangular shape, etc., and in the case of being located between two lanes, may be of an elliptical shape, of one or more circles shape, of a triangular shape, of a rectangular shape, etc.

The corners of the protruding element (1) shown in the figures are rounded, but they may be of different shapes, for example, bevelled edge or cornered, depending on the construction or manufacturing process.

No building materials, or colours or types of signs are specified because their functionality does not depend on them, but on their shape and arrangement.

In the case of roads with narrow lanes, it may be possible to install the protruding elements changing the alignment of the curbs in order to take a concave curved shape similar to the geometry of the protruding element.

The invention claimed is:

1. A device for limiting the speed of moving traffic, comprising:

at least one protruding element (1) positioned on the surface of a road that is open to traffic in such a way that the protruding element (1) intervenes in the path of a vehicle (3), wherein the protruding element (1) comprises a directrix line (1.1) which in a plan view has a curved shape, and the protruding element (1) is positioned in the direction of the travel of the vehicle (3) in such a way that the width (1.2) of a projection of the protruding element (1) on a transverse plane to a traffic lane is greater than the width between wheels of the same axis of a largest vehicle (3) that is anticipated to use the road and whose speed is going to be controlled, canted left and right side walls that cause the vehicle (3) to fall to the road due to the effect of gravity while following the path along the protruding element (1), lowered ends and having a different height in the center of the protruding element (1) with respect to the lowered ends, so as to dissuade drivers from passing over, where the maximum width (1.3) of the cross section is less than or equal to the width between wheels of the same axis of the smallest vehicle (3) whose speed is going to be controlled; and a hump (2) that is aligned on a same transverse axis (5) of the road as the at least one protruding element (1), with the hump (2) being located on at least one side of the lane or lanes, so that the distance (2.2) between the protruding element (1) and the hump (2) is less than the distance between the wheels of the same axis of the smallest vehicle (3) whose speed is going to be controlled, thereby allowing that vehicles with a greater width between wheels of the same axis than the width (1.2) of the projection of the protruding element (1) can go straight without being affected by the device.

2. A device for limiting the speed of moving traffic, according to claim 1, wherein the width of the cross section to the directrix line (1.1) is constant along the protruding element (1).

3. A device for limiting the speed of moving traffic, according to claim 1, wherein the width of the cross section to the directrix line (1.1) is not constant along the protruding element (1).

4. A device for limiting the speed of moving traffic, according to claim 1, wherein the corners of the protruding element (1) are rounded, cornered or bevelled.

5. A device for limiting the speed of moving traffic, according to claim 1, wherein the protruding element (1) is symmetrical about the transverse axis (5) of the road.

6. A device for limiting the speed of moving traffic, according to claim 1, wherein the protruding element (1) is asymmetrical about the transverse axis (5) of the road.

7. A device for limiting the speed of moving traffic, according to claim 1, wherein said at least one protruding element (5) comprises one protruding element (1) on each lane of the road.

8. A device for limiting the speed of moving traffic, according to claim 1, wherein the curvature of the protruding element (1) requires the vehicle (3) to move in left and right directions when following the path of the protruding element (1).

9. A device for limiting the speed of moving traffic, according to claim 1, wherein the hump (2) comprises a rectangular shape or a half ellipse shape, or a semicircle or a triangular shape, placed on a single lane road.

10. A device for limiting the speed of moving traffic, according to claim 1, wherein the hump (2) comprises a rectangular shape or an ellipse shape, or a circular shape or a triangular shape, placed between two lanes of a road with its longitudinal axis (2.1) coinciding with the line of separation of lanes (4).

11. A device for limiting the speed of moving traffic, according to claim 1, wherein the maximum width of the hump (2) will be larger than the separation of wheels of the same axis of the largest vehicle (3) whose speed is going to be controlled.

12. A device for limiting the speed of moving traffic, according to claim 1, wherein the center of the protruding element (1) has a trapezoidal cross section.

* * * * *